US005945390A

United States Patent [19]

Veltman et al.

[11] Patent Number: 5,945,390

[45] **Date of Patent: *Aug. 31, 1999**

[54] TOILET CLEANSING BLOCK

[75] Inventors: Jerome J. Veltman, Racine; Russell B. Wortley, Kenosha; Michael E. Klinkhammer, Racine, all of Wis.

[73] Assignee: S. C. Johnson & Son, Inc., Racine, Wis.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/651,161

[22] Filed: May 17, 1996

[51] Int. Cl.[6] ..... C11D 17/00; C11D 3/22; B08B 3/04

[52] U.S. Cl. ..... 510/191; 510/192; 510/445; 510/446; 510/447; 510/473; 510/495; 4/223; 4/227.1; 134/38; 134/42

[58] Field of Search ..... 510/191, 192, 510/193, 495, 445, 446, 447, 450, 473; 4/223, 227.1; 134/38, 42

[56] References Cited

U.S. PATENT DOCUMENTS

| | | | |
|---|---|---|---|
| 3,708,425 | 1/1973 | Compa et al. . | |
| 4,026,813 | 5/1977 | Lamberti et al. . | |
| 4,119,578 | 10/1978 | Daeninckx et al. . | |
| 4,269,723 | 5/1981 | Barford et al. . | |
| 4,396,522 | 8/1983 | Callicott et al. . | |
| 4,459,710 | 7/1984 | Keyes et al. . | |
| 4,460,490 | 7/1984 | Barford et al. | 510/192 |
| 4,476,046 | 10/1984 | Wong et al. | 510/192 |
| 4,477,363 | 10/1984 | Wong et al. . | |
| 4,683,072 | 7/1987 | Holdt et al. . | |
| 4,722,801 | 2/1988 | Bunczk et al. . | |
| 4,722,802 | 2/1988 | Hutchings et al. . | |
| 4,738,728 | 4/1988 | Barford et al. . | |
| 4,820,449 | 4/1989 | Menke et al. . | |
| 4,911,857 | 3/1990 | Bunczk et al. | 510/193 |
| 4,994,266 | 2/1991 | Wells . | |
| 5,089,174 | 2/1992 | Kaw et al. . | |
| 5,158,778 | 10/1992 | Donovan et al. . | |
| 5,188,755 | 2/1993 | Chang . | |
| 5,205,955 | 4/1993 | Bunczk et al. . | |
| 5,332,519 | 7/1994 | Mazzola . | |
| 5,336,427 | 8/1994 | Bunczk et al. . | |
| 5,449,473 | 9/1995 | Bunczk et al. . | |
| 5,562,850 | 10/1996 | Woo et al. | 510/151 |
| 5,759,974 | 6/1998 | Menke et al. | 510/191 |

FOREIGN PATENT DOCUMENTS

| | | |
|---|---|---|
| 0122664 | 4/1984 | European Pat. Off. . |
| 0462643 | 6/1991 | European Pat. Off. . |
| 2021143 | 6/1979 | United Kingdom . |

*Primary Examiner*—Lorna Douyon

[57] ABSTRACT

A toilet cleansing block contains anionic surfactant such as a sulfonate, linear primary alcohol such as Neodol® 23, and binder such as hydroxy ethyl cellulose. The block erodes very slowly, yet at essentially identical rates in hard or soft water. The block is for use with a dispenser for immersion in toilet tanks or under the rim of a toilet basin.

8 Claims, No Drawings

TOILET CLEANSING BLOCK

TECHNICAL FIELD

The present invention relates to cleansing blocks suitable for use in a dispensing devices immersed in toilet tanks or attached under the rim of toilet basins. The blocks slowly release a cleaning agent into toilet basins each time the toilets are flushed.

BACKGROUND ART

Various cleansing blocks for use in toilet tanks and other water reservoirs are known. Such cleansing blocks typically contain a surfactant for cleaning, and often oxidizing agents, fillers, binders, colorants and perfumes. They are designed to slowly release these materials into the toilet basin each time the toilet is flushed. See. U.S. Pat. Nos. 4,269,723; 4,722,801; 4,722,802; 4,738,728; 4,820,449; 5,336,427; and 5,449,473. The disclosure of these patents, and of all other publications referred to herein, are incorporated by reference as if fully set forth herein.

Such blocks should not include materials which leave undesirable residues in the toilet bowl, which are environmentally unacceptable, or which have unpleasant odors. While blocks having these desired attributes have been created, there are sometimes unsatisfactory trade-offs between desired attributes for each formulation.

As useful life is extended, it is particularly difficult to insure consistent performance independent of water hardness or softness. Variations in the hardness of the water supply can affect the rate of dissolution, especially when the block is designed for very long life. The consumer dissatisfaction associated with inconsistent performance is increasingly of concern as more and more people use softened water or move to soft water areas.

Thus, it can be seen that a need exists for an improved water tank cleansing block that can be utilized in a toilet cleansing dispenser.

DISCLOSURE OF INVENTION

In one aspect, the invention provides a water reservoir cleansing block for use in an in-tank dispenser having about 3%–15%, preferably about 3–10% by weight of linear primary alcohol, where the alcohol has between nine and twenty carbons. There is also 30%–70% by weight of anionic surfactant. The block is formulated and configured such that the time for the block to essentially completely dissolve in the "In-tank Test" described herein in softened water would be at least 70% of the time for the block to essentially completely dissolve in said In-tank Test in water hardness of about 115–130 ppm expressed in terms of calcium of carbonate. Further, in neither such test would the block essentially completely dissolve prior to 150 flushes. The block for use in an in-tank dispenser can also have up to about 3% by weight of binder selected from the group consisting of cellulose binder and gum.

In a preferred form, the alcohol is a fatty alcohol, the anionic surfactant is a sulfonate, and the binder is hydrated cellulosic material. Such blocks can achieve both long life and consistent performance across a wide range of water hardness.

In yet another embodiment, the invention provides a method of cleaning a basin of a toilet. One places such blocks in a dispenser which is immersed in a water reservoir for the toilet basin, and flushes the toilet. In a further embodiment, such blocks are placed in a dispenser attached under the rim of the toilet basin, and flushes the toilet. The cleansing blocks of the present invention are designed to dissolve in lavoratories at ambient temperatures from about 10° C. to about 30° C.

Various known anionic surfactants are useful in connection with the present invention. Preferred surfactants include alkali metal salts of alkyl, alkenyl and alkylaryl sulfates and sulfonates. Some such anionic surfactants have the general formula $ROSO_3M$ or $RSO_3M$, where R may be an alkyl or alkenyl group of about 8 to about 20 carbon atoms, or an alkylaryl group, the alkyl portion of which may be a straight- or branched-chain alkyl group of about 9 to about 15 carbon atoms, the aryl portion of which may be phenyl or a derivative thereof, and M may be an alkali metal (e.g. sodium, potassium or lithium). As an alternative, M may be a nitrogen derivative (e.g. amino or ammonium). A preferred anionic surfactants include sodium lauryl sulfate, sodium lauryl ether sulfate and sodium dodecyl benzene sulfonate. The most preferred anionic surfactants are sodium alkylaryl sulfonate sold commercially by Albright & Wilson Warley, England under the trademark "NANSA" HS 85/S, and "UFARYL" DL85 sold by Unger Fabrikker, Fredistad, Norway, either individually or in combination.

For under-the-rim cleansing blocks, amphoteric surfactants such as coconut and lauryl amides may be utilized in amounts from about 0 to about 10% by weight, preferably from about 0% to about 5%, and most preferably about 3.0% by weight.

The preferred alcohol is Neodol 23 marketed by Shell Oil Company. It is a mixture of $C_{12}$ and $C_{13}$ linear primary alcohol. As alternatives, it is believed that any linear (unbranched) primary fatty alcohol of less than $C_{21}$, and greater than $C_8$ (and mixtures thereof) will also be suitable. Examples are 1-dodecanol; EPAL- 16 (by Ethyl Corporation) which is a mixture of decanol, dodecanol, tetradecanol, and octadecanol; and ALFOL 1214 (by Vista Chemical Co.) which is a mixture of dodecanol and tetradecanol.

A dye or colorant is also optionally included (at levels from about 3% to 20%). The choice of the coloring agent will largely depend on the color desired for the water into which the lavatory cleanser composition is to be dispensed. A preferred coloring agent is Acid Blue 9.

The amount of coloring agents or dyes to be dispensed into the water will depend on the color intensity desired and the cost of the dye. The absorbance of the coloring agents or dyes may be determined for laboratory purposes through the use of a visible spectrophotometer, such as a Perkin-Elmer Model 552 spectrophotometer.

The amount of coloring agents or dyes delivered in the toilet bowl should be sufficient to provide an absorbance in a 1 cm spectrophotometric cell of from about 0.02 absorbance units ("a.u.") to about 0.2 a.u. when measured at its wavelength maxima. This is because consumers typically believe that a colored cleansing product is no longer working ("essentially completely dissolved") when it has a color intensity below this range.

A binder may be used to help maintain block integrity. Especially preferred binders are the hydrated cellulose material of U.S. Pat. No. 4,722,802, such as hydroxy alkyl cellulose (especially hydroxy ethyl cellulose or hydroxy propyl cellulose).

Gum binders may also be used. Examples are guar, xanthan, tragacanth, carrageenan, karaya, or algin.

To achieve adequate density so that the block will not float in an in-tank dispenser, easier to insert in a rim-block cage dispenser, and to keep costs to the minimum, inert fillers can be added (typically 0%–60% by weight for in-tank dispenser use and 0–40% by weight for under-the-rim composition ). Inert salts are preferred such as water-soluble inorganic or organic salts (or mixtures of such salts).

Examples include various alkali metal and/or alkaline earth metal sulfates, chlorides, borates, and citrates. Specific inert salts are sodium sulfate, calcium sulfate, sodium chloride, potassium sulfate, sodium carbonate, lithium chloride, tripotassium phosphate, sodium borate, potassium fluoride, sodium bicarbonate, calcium chloride, magnesium chloride, sodium citrate, magnesium sulfate and sodium fluoride.

A perfume or fragrance can also be added, depending on the type of aroma that is to be imparted. For instance, pine, citrus and potpourri scents can be employed. An especially preferred pine scent can be provided by isobomyl acetate.

Other additives that can be included in the block are other cleaning agents (e.g. borax) and preservatives (e.g. Dow Chemical's Dowicil 75).

By setting the ratio of alcohol to surfactant between about 1:3 and 1:20 (preferably about 1:6 to 1:15) by weight, with the specified overall amounts, a block can be created that has essentially the same rate of dissolution across a wide range of typical water hardness. In that prior art toilet cleanser blocks typically dissolve faster in soft water, it is desirable that the blocks last at least 70% as long in soft water than in hard water. Also, it is desirable that blocks used in soft water not outlast blocks used in hard water by more than 10%.

The objects of the present invention therefore include providing a water reservoir cleansing block of the above kind:

(a) having essentially the same rate of dissolution across a wide range of typical water hardness;

(b) which dissolves in the toilet at a slow rate;

(c) which maintains toilet basins in a clean condition in normal use; and (d) which uses environmentally acceptable and inexpensive components.

These and still other objects and advantages of the present invention (e.g. methods for using these blocks) will be apparent from the description which follows. The following description is merely of the preferred embodiments. Thus, the claims should be looked to in order to understand the full scope of the invention.

BEST MODES FOR CARRYING OUT THE INVENTION

A preferred cleansing block for use in an in-tank toilet dispenser:

| Ingredient | Weight % | Alternative Range |
|---|---|---|
| Sodium Sulfate | balance | 0–60% |
| Acid Blue #9 dye 100% powder | 20.00 | 0–20% |
| Cellosize HEC QP-52000 H (hydroxy ethyl cellulose) | — | 0–3% |
| Pine Oil | 4.00 | 0–10% |
| Neodol 23 Linear Primary Alcohol | 4.00 | 2–10% |
| Ufaryl DL-85 Alkyl Aryl Sulfonate | 60.00 | 30–70% |

Other example cleansing blocks for use with an under-the-rim dispenser:

| Ingredient | Weight % | Alternative Range |
|---|---|---|
| Sodium Sulfate | 12.00 | 0–40% |
| Acid Blue #9 dye 100% powder | 10.00 | 0–6% |
| Coconut and Lauryl Amides | 3.00 | 0–10% |
| Neodol 23 Linear Primary Alcohol | 4.00 | 2–10% |
| Ufaryl DL-85 Alkyl Aryl Sulfonate | 67.00 | 30–75% |
| Sodium Lauryl Ether Sulfate | 5.00 | 0–10% |
| Isoborneal Acetate | 4.00 | 0–10% |
| Cellosize HEC QP-52000 H (hydroxy ethyl cellulose) | — | 0–2% |

To make such blocks we blend the solid components together. We then add the liquid(s) and blend all the materials together. The resultant flowable mixture is then extruded into "noodles," with the noodles then being compressed and cut into blocks (e.g. 50 g. pucks).

Alternatively, we could first create a homogeneous blend using a mixer such as a ribbon blender. The blend can then be fed into the barrel of a screw extruder and passed through the extruder to form a continuous extrudate which is then cut to the size block desired.

Although exact extruding conditions will vary from extruder to extruder, the barrel of the extruder can be maintained at a temperature between about 250° C. and 35° C. (e.g. an ambient temperature) by means of cooling water circulated through an external barrel jacket. The die head may be heated to assure a smoother surface of the product extrudate.

The block in the continuous extrudate form begins to cure upon leaving the extruder, and hence can be cut into cleansing blocks of requisite size by conventional cutting means downstream of the die and before substantially complete curing. The "block" need not be rectangular. It may be a tablet, disk, brick, or other solid mass, with or without crevices, holes or the like, and need not be formed by extrusion (albeit extrusion is preferred). Thus, any solid form mass is intended to be a "block" for purposes of this patent.

To use the blocks of the present invention, we place a block in the dispenser and place it in a conventional toilet tank or under the rim of a conventional toilet bowl and flush the toilet in the usual manner.

COMPARATIVE TESTS

In a first set of tests (our standard "In-tank Test" conditions), each tested block was inserted in a dispenser described in U.S. application Ser. No. 08/398,040, entitled "Passive Lavatory Cleanser Dispensing System," now abandoned. The dispenser containing the block was then inserted in the toilet tank of the Mansfield model 35 toilet (Mansfield Corporation; Perrysville, Ohio). This toilet is designed to dispense 3.5 gallons (about 13.25 liters) per flush. The toilets are flushed ten times daily. The block is preferably inserted at time zero of the first day. The tank is then flushed at the end of hours 8, 9, 10, 14, 15, 19, 20, 21, 22, and 23, with the flushing pattern being repeated each twenty-four hours thereafter. The water temperature is about 56–58° F. (about 13–14° C.) for the testing in hard water and about 64–68° F. (about 18–° C.) for testing in soft water. In the case of comparative tests, about 10 g blocks of the same shape were formed (in the standard test, block shaped).

In some tests we used tap water with 115–120 ppm hardness expressed in terms of calcium carbonate (or its Mg/Ca equivalent) to illustrate hard water performance. In other tests we used either deionized pure water or water softened by an ion-exchange method so as to remove substantially all calcium and magnesium. This simulated performance with softened/non-hard water.

The cleansing blocks of the present invention were compared to pucks having the following formula (which is similar to a known prior art "bleaching" puck system):

| Ingredient | Percentage |
|---|---|
| Nansa HS/85S | 61.00 |
| Sodium dichloroisocyanurate | 30.00 |
| Neodol 91 ($C_9$–$C_{11}$ alcohol) | 8.00 |
| Mineral oil | 1.00 |

Such bleaching pucks weighing about 10 g exhibited large differences in dissolution rates between soft or hard water test conditions described above.

In contrast, blocks of the present invention lasted at least 70% as long in soft water conditions at about 18–20° C. as in hard water conditions at about 13–14° C.

Dissolution rates may be confirmed more precisely by measuring the blue color level in the toilet basin water by the techniques noted above (in the case of the present invention), and by measuring chlorine levels in the basin in the case of the bleaching pucks.

Under-the-Rim Test:

In a second set of tests (our standard "Under-the-Rim Test" conditions), each tested block was inserted in a cage dispenser as described in U.S. Pat. No. 4,777,670, entitled "Under-the-Rim Dispensing Unit," which was then inserted under the rim of the toilet basin of the Mansfield model 35 toilet (Mansfield Corporation; Perrysville, Ohio). This toilet is designed to dispense 3.5 gallons (about 13.25 liters) per flush. The toilets are flushed ten times daily. The cage is preferably inserted at time zero of the first day. The tank is then flushed at the end of hours 8, 9, 10, 14, 15, 19, 20, 21, 22, and 23, with the flushing pattern being repeated each twenty-four hours thereafter. The water temperature is about 56–58° F. (about 13–14° C.) for the testing in hard water and about 64–68° F. (about 18–20° C.) for testing in soft water. In the case of comparative tests, about 10 g blocks of the same shape were formed (in the standard test, block shaped). It should also be noted that the blocks will typically swell and increase in weight due to the absorption of water.

Such bleaching pucks weighing about 10 g exhibited large differences in dissolution rates between soft or hard water test conditions described above.

In contrast, blocks of the present invention lasted at least 70% as long in soft water conditions at about 18–20° C. as in hard water conditions at about 13–14° C.

Dissolution rates may be confirmed more precisely by measuring the blue color level in the toilet basin water by the techniques noted above (in the case of the present invention), and by measuring chlorine levels in the basin in the case of the bleaching pucks.

Thus, it can be seen that the present invention can achieve effective cleaning over a very long product life, with hard water and soft water life that is more consistent compared to prior art compositions. While not wishing to be bound to any theory, it believed that this effect is due to the formation of protective reverse hexagonal phase liquid crystals when the specified alcohols and surfactants are present in the specified ratios and amounts.

It should be appreciated that the above discussion merely relates to preferred forms of the invention. For other surfactants, alcohols, and binders, the constituent amounts can be adjusted to achieve similar performance in hard and soft water consistent with the teachings of the above examples, guidelines, and test procedures.

INDUSTRIAL APPLICABILITY

The invention is useful in maintaining the cleanliness of toilet bowls associated with toilet tanks. It should also have applicability in other water reservoir applications (e.g. tanks for urinals).

We claim:

1. A homogenous water reservoir cleansing block consisting essentially of:

3–10by weight of linear primary alcohol, wherein the alcohol has between nine and twenty carbons;

30–70by weight of anionic surfactant;

a hydrated cellulose binder which is present in the block but is not more than 3% by weight of the block; and one or more fillers;

wherein the weight ratio of the alcohol to the surfactant is between 1:3 and 1:20;

wherein the block is formulated and configured such that the time for the block to essentially completely dissolve in the "In-tank Test" in water of essentially zero hardness as expressed in terms of calcium carbonate and at a temperature of between 18–20° C. would be at least 70% of the time for the block to essentially completely dissolve in said In-tank Test in water containing between 115–130 ppm hardness expressed in terms of calcium carbonate, and at a temperature of about 13–14° C.;

wherein in neither such test would the block essentially completely dissolve prior to 150 flushes; and wherein the block further comprises a binder selected from the group consisting of cellulose binder and gum which is present in the block but is not more than 3% by weight of the block.

2. The cleansing block of claim 1 wherein the alcohol is a mixture of $C_{12}$ and $C_{13}$ linear primary alcohol.

3. The cleansing block of claim 1, wherein the anionic surfactant is a sulfonate.

4. A method of cleaning a basin of a toilet comprising the steps of placing the block of claim 1 in a lavatory dispenser, immersing the dispenser in a water reservoir for the toilet basin, and flushing the toilet.

5. A homogenous water reservoir cleansing block consisting essentially of:

3%–10% by weight of linear primary alcohol, wherein the alcohol has between nine and twenty carbons;

30–70 by weight of anionic surfactant;

a hydrated cellulose binder which is present in the block but is not more than 3% by weight of the block; and one or more fillers;

wherein the weight ratio of the alcohol to the surfactant is between 1:3 and 1:20;

wherein the block is formulated and configured such that the time for the block to essentially completely dissolve in the "Under-the-Rim Test" in water of essentially zero hardness as expressed in terms of calcium carbonate and at a temperature of between 18–20° C. would be at least 70% of the time for the block to essentially completely dissolve in said Under-the-Rim Test in water containing between 115–130 ppm hardness expressed in terms of calcium carbonate and at a temperature of between 13–14° C.; and wherein in neither such test would the block essentially completely dissolve prior to 150 flushes.

6. The cleansing block of claim 5, wherein the alcohol is a mixture of $C_{12}$ and $C_{13}$ linear primary alcohol.

7. The cleansing block of claim 5, wherein the anionic surfactant is a sulfonate.

8. A method of cleaning a basin of a toilet comprising the steps of placing the block of claim 5 in a lavatory dispenser, attaching the dispenser under the rim of a toilet basin, and flushing the toilet.

* * * * *

UNITED STATES PATENT AND TRADEMARK OFFICE

CERTIFICATE OF CORRECTION

PATENT NO. : 5,945,390

DATED : August 31, 1999

INVENTOR(S) : Jerome J. Veltman et al.

It is certified that error appears in the above-identified patent and that said Letters Patent is hereby corrected as shown below:

| | |
|---|---|
| Column 6, Line 32: | 3-10% by weight |
| Column 6, Line 34: | 30-70% by weight |
| Column 6, Line 53: | ...150 flushes (; and) . |
| Column 6, Lines 54-57: | Delete per Examiner's Amendment of 1/17/99. |

Signed and Sealed this

Nineteenth Day of September, 2000

*Attest:*

Q. TODD DICKINSON

*Attesting Officer*

*Director of Patents and Trademarks*